US006121547A

United States Patent [19]

Harada

[11] Patent Number: 6,121,547

[45] **Date of Patent: *Sep. 19, 2000**

[54] BRAIDED WIRE

[75] Inventor: Jiro Harada, Tokyo, Japan

[73] Assignee: Harada Industry Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,940

[22] Filed: Aug. 12, 1997

[30] Foreign Application Priority Data

Aug. 12, 1996 [JP] Japan ..... 8-212429

[51] Int. Cl.[7] ..... H01B 7/34

[52] U.S. Cl. ..... 174/36; 174/109; 87/8

[58] Field of Search ..... 174/36, 109; 156/47, 156/51; 87/8, 9, 13; 138/123

[56] References Cited

U.S. PATENT DOCUMENTS 4,567,917 2/1986 Millard ..... 87/9 X 4,973,370 11/1990 Kreinberg ..... 156/51 X 5,118,905 6/1992 Harada ..... 174/109

5,186,992 2/1993 Kite, III ..... 87/8 X 5,443,422 8/1995 Heimberger ..... 87/9 X 5,504,274 4/1996 McCabe et al. ..... 174/36

*Primary Examiner*—Kristine Kincaid

*Assistant Examiner*—Chau N. Nguyen

*Attorney, Agent, or Firm*—John P. White; Cooper & Dunham LLP

[57] ABSTRACT

A braided wire according to the present invention is constituted by weaving a plurality of first long conductors arranged in parallel and a plurality of second long conductors arranged in parallel so as to cross the first long conductors each other. Each of the first and second long conductors has a section which is perpendicular to an axis thereof and flattened such that a thickness of the conductor is decreased toward both end portions in a width direction. The first and second long conductors each having the flattened section are woven such that they are put one on another in a thickness direction.

4 Claims, 4 Drawing Sheets

BRAIDED WIRE

BACKGROUND OF THE INVENTION

The present invention relates to a braided wire used as an outer conductor of a coaxial cable, a shielding layer of an electronic device, and the like.

As is well-known, a coaxial cable for use in an electronic device, etc. is constituted of at least a center conductor, an insulator covering the center conductor, an outer conductor or a shielding layer covering the insulator, and an outer coating covering the outer conductor.

A braided wire formed by weaving long conductors each having a circular section, is usually used as an outer conductor of the coaxial cable, the section being perpendicular to the axis of the conductor.

Since, as described above, the conventional braided wire employs a long conductor having a circular section as a strand, the thickness of the braided wire is proportionate to the diameter of the long conductor. If a thick, long conductor is used as a strand in order to improve in mechanical strength and shielding function of the braided wire, then the thickness of the braided wire will be increased, as will be the outside diameter of the coaxial cable. Consequently, in an electronic device using the above coaxial cable, a large diameter of the cable will prevent the device from increasing in density.

If a thin, long conductor is employed as a strand in order to reduce in both thickness of the braided wire and outside diameter of the coaxial cable, the strength of the long conductor is decreased, and the conductor is easily disconnected at the stage of manufacture of the braided wire, thus deteriorating in yield and increasing in costs. Since, furthermore, the finished braided wire is lowered in mechanical strength and easy to be broken, the shielding function is not effectively fulfilled.

BRIEF SUMMARY OF THE INVENTION

An object of the present invention is to provide a braided wire which is thinner than a prior art one and has the same mechanical strength and shielding function as those thereof.

Another object of the present invention is to provide a braided wire capable of contributing to down-sizing of an electronic device by making an outside diameter of a coaxial cable smaller than that of a prior art one having the same function when the braided wire is applied to an outer conductor.

To achieve the above objects, the braided wire according to the present invention has the following construction:

(1) A braided wire constituted by weaving a plurality of first long conductors arranged in parallel and a plurality of second long conductors arranged in parallel so as to cross the first and second long conductors each other, wherein each of the first and second long conductors has a section which is perpendicular to an axis thereof and flattened such that a thickness of the conductor is decreased toward both end portions in a width direction, and the first and second long conductors each having the flattened section are woven such that they are put one on another in a thickness direction.

(2) The braided wire described in above (1), wherein each of the first and second long conductors is formed by flattening a long conductor having a circular section crossing an axis thereof.

(3) The braided wire described in above (1), wherein the section of each of the long conductors crossing the axis thereof is determined such that a ratio (t1/W) of thickness t1 of a middle portion to width W is about (6 to 8)/100, while a ratio (t2/W) of thickness t2 of end portions to width W is about (2 to 3)/100.

(4) A braided wire constituted by weaving a plurality of first long conductor bunches arranged in parallel and a plurality of second long conductor bunches arranged in parallel so as to cross the first and second long conductor bunches each other, wherein each of the long conductor bunches includes a plurality of long conductors arranged in a width direction thereof, each of the long conductors has a section which is perpendicular to an axis thereof and flattened such that a thickness of the long conductor is decreased toward both end portions in the width direction, and the first and second long conductor bunches are woven so as to be put one on another in a thickness direction.

(5) The braided wire described above (4), wherein the first and second long conductor bunches are formed by horizontally arranging the long conductors such that end portions of adjacent long conductors are put one on another.

(6) The braided wire described above (1), which is applied to an outer conductor of a coaxial cable constituted of a center conductor, an insulator covering the center conductor, the outer conductor covering the insulator, and an outer coating covering the outer conductor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, servo to explain the principles of the invention.

DETAILED DESCRIPTION OF THE INVENTION (First Embodiment)

Figure 1:
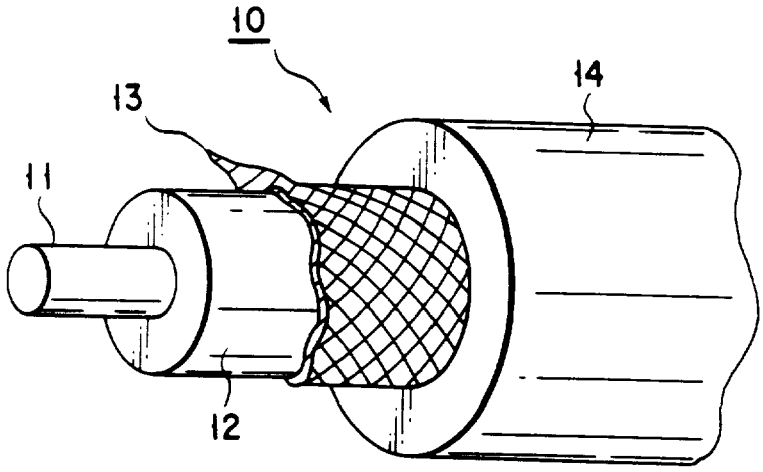
FIG. 1 is a perspective view of the construction of a braided wire according to a first embodiment of the present invention, which is applied to an outer conductor of a coaxial cable.

FIG. 1 is a perspective view of the construction of a braided wire according to a first embodiment of the present invention. The braided wire is applied to an outer conductor 13 of a coaxial cable 10. As illustrated in FIG. 1, the coaxial cable 10 used for an electronic device and the like, is constituted of a center conductor 11, an insulator 12 covering the center conductor 11, an outer conductor 13 covering the insulator 12, and an outer coating 14 covering the outer conductor 13.

Figure 2:
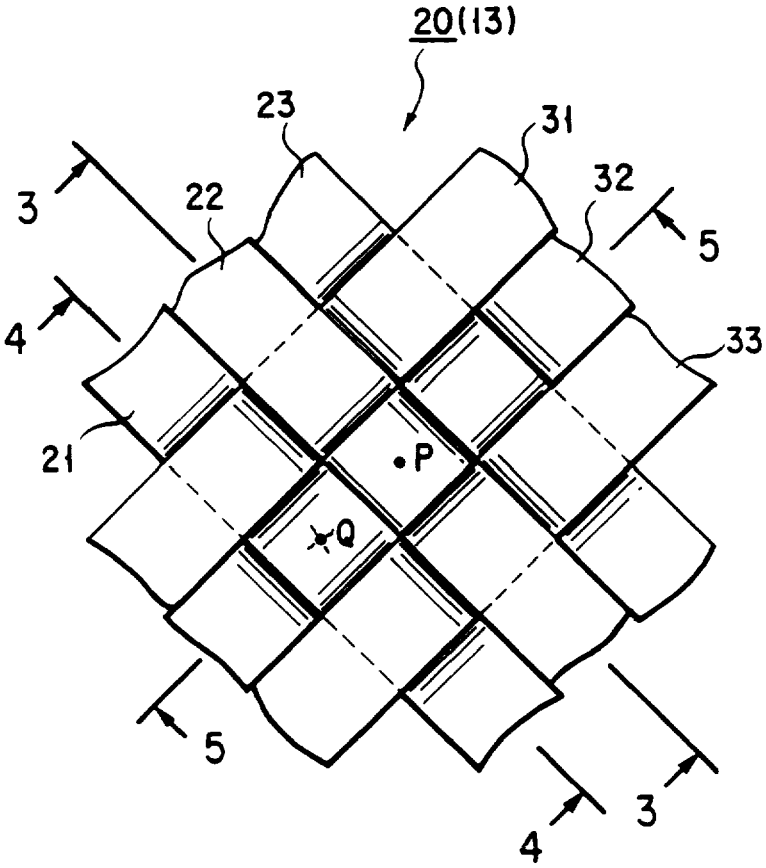
FIG. 2 is a partially cutaway plan view of the braided wire shown in FIG. 1.

FIG. 2 is a partially cutaway plan view of a braided wire 20 used as the outer conductor 13 described above. Referring to FIG. 2, the braided wire 20 constituting the outer conductor 13 includes a plurality of first long conductors 21, 22, 23, . . . arranged in parallel and a plurality of second long conductors 31, 32, 33, . . . arranged in parallel and crossing the first long conductors. The first and second long conductors are woven so as to have a checkered pattern.

Figure 3:
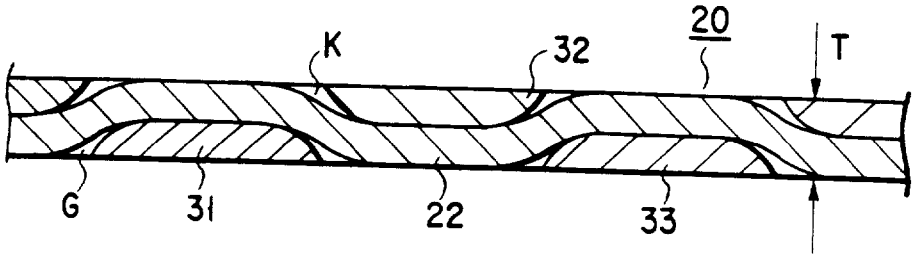
FIG. 3 is a cross-sectional view of FIG. 2 taken along line 3—3 of FIG. 2.
Figure 4:
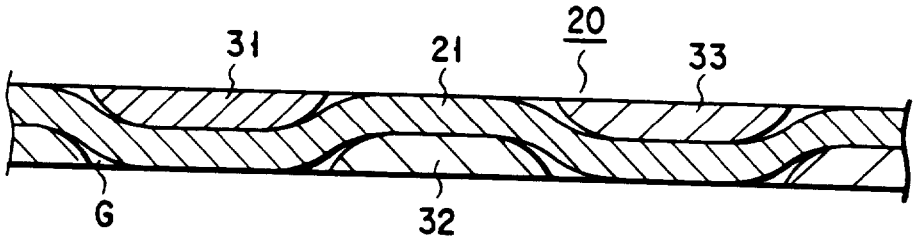
FIG. 4 is a cross-sectional view of FIG. 2 taken along line 4—4 of FIG. 2.
Figure 5:
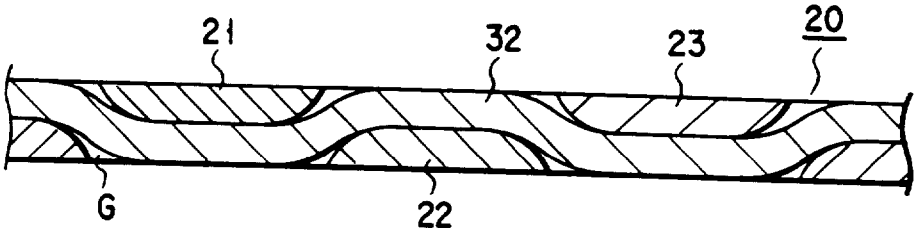
FIG. 5 is a cross-sectional view of FIG. 2 taken along line 5—5 of FIG. 2.
Figure 6:
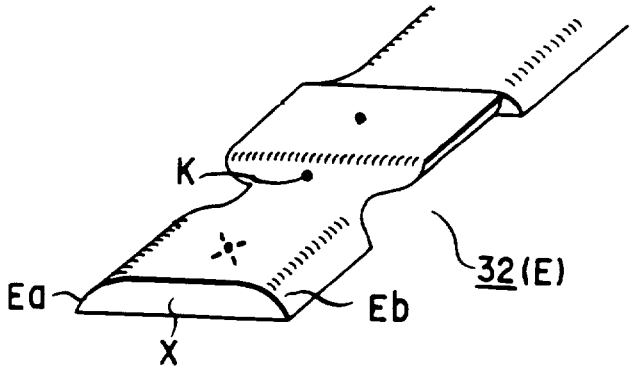
FIG. 6 is a partially cutaway perspective view of a single long conductor woven as the braided wire according to the first embodiment of the present invention.

FIG. 3 is a cross-sectional view of FIG. 2 taken along line 3—3 of FIG. 2, FIG. 4 is a cross-sectional view of FIG. 2 taken along line 4—4 of FIG. 2, and FIG. 5 is a cross-sectional view of FIG. 2 taken along line 5—5 of FIG. 2. FIG. 6 is a partially cutaway perspective view of a single long conductor woven as the braided wire.

As is apparent from FIGS. 3 to 6, each of the first and second long conductors has a section which is perpendicular to an axis thereof and flattened such that a thickness thereof is decreased toward both end portions in the width direction. These first and second long conductors are obtained by flattening long conductors each having a circular section by pressing. In other words, each of the first and second long flat conductors has a cross section which is perpendicular to an axis thereof, the cross section having a first flat side, a second flat side parallel to and longer than the first flat side, and both end sides curved from the first flat side to the second flat side so that both end portions of the cross section as viewed in a width gradually decrease in thickness and the first flat side being in contact with the other of the first and second long flat conductors, as shown in FIGS. 3 to 6.

Since, in the braided wire 20, each long conductor E having a section X crossing an axis thereof is flattened, the thickness of the braided wire 20 is considerably smaller than that of a conventional braided wire using long conductors each having the same area and a circular section crossing the axis, with the result that the braided wire 20 can greatly be thinned. As compared with a case where a small-diameter conductor is employed to reduce the thickness of the braided wire 20, the mechanical strength of the long conductor E is hardly lowered; therefore, the mechanical strength of the braided wire 20 is in no way inferior to that of the conventional one.

What is to be noted in particular is that, in an overlap between one (first) long conductor E and another (second) long conductor E crossing each other, both end portions Ea and Eb of the first long conductor E in its width direction, toward which the conductor E decreases in thickness, can naturally be formed so as to conform to a slant portion K which exhibits a "swell" formed along the longitudinal direction of the second long conductor E and in the thickness direction thereof and, in other words, a flexible "conformability" occurs between adjacent conductors. For this reason, a gap G caused by a step of the overlap between the crossing long conductors E is very small, with the result that the first and second long conductors has almost flat faces and few irregularities, though they are woven so as to cross each other. Thus, the braided wire has an outward appearance which is substantially the same as that of a single plate-like conductor having a fixed thickness T (which is about twice as great as that of each long conductor E). Consequently, the handling of the braided wire 20 is simplified and the shielding function thereof is improved. Furthermore, the wire 20 increases in mechanical strength and has flexibility at the same time.

(Second Embodiment)

Figure 7:
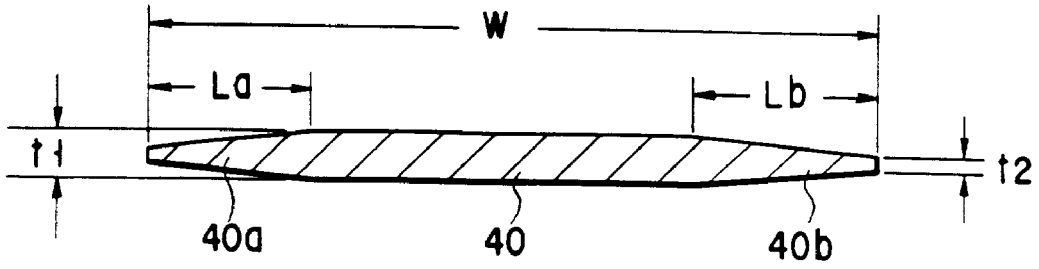
FIG. 7 is a cross-sectional view of the construction of a braided wire according to a second embodiment of the present invention, which has a section perpendicular to an axis of a single long conductor woven as the braided wire.

FIG. 7 is a cross-sectional view of the construction of a braided wire according to a second embodiment of the present invention, showing a section perpendicular to an axis of a single long conductor 40 woven as the braided wire. As illustrated in FIG. 7, in the section of the braided wire, a ratio (t1/W) of thickness t1 of the middle portion to width W is about (6 to 8)/100, while a ratio (t2/W) of thickness t2 of the end portions to width W is about (2 to 3)/100.

Specific numerical values (in the experiment on a trial product) are as follows: Width W is 0.9 mm, thickness t1 is 0.06 mm, and thickness t2 is 0.02 mm to 0.03 mm. The lengths La and Lb of both end portions 40*a* and 40*b* of the conductor 40 in the width direction, which are gradually decreased in thickness, are each about 0.2 mm to 0.3 mm. Various tests were carried out on the conductor having the above numerical values and good results satisfying the required conditions were obtained.

Figure 8:
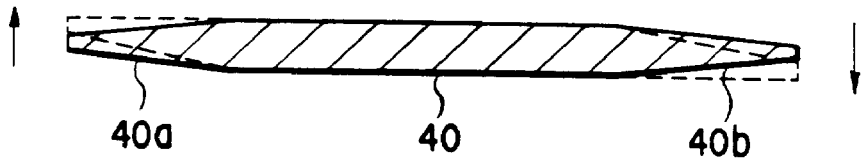
FIG. 8 is a view of a basic operation of the braided wire according to the second embodiment of the present invention.

FIG. 8 is a view of a basic operation of the braided wire according to the second embodiment of the present invention, which shows variations in the section perpendicular to the axis of the long conductor 40. As illustrated in FIG. 8, the end portions 40*a* and 40*b* of the long conductor 40 can easily be bent by applying force in the thickness directions as indicated by the arrows. For example, as shown by the broken lines, the end portion 40*a* (on the left side of FIG. 8) can be bent upward, while the end portion 40*b* (on the right side thereof) can be bent downward. Therefore, as shown in FIGS. 3 to 5, when the long conductors are woven as a braided wire, the "conformability" between them is enhanced, and a gap G hardly occurs between them.

Figure 9:
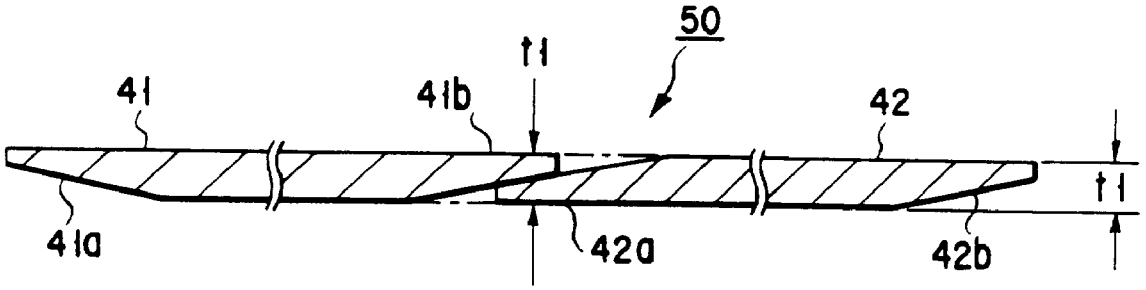
FIG. 9 is a view of an applied example of the braided wire according to the second embodiment of the present invention.

FIG. 9 is a view of an applied example of the braided wire according to the second embodiment of the present invention. As illustrated in FIG. 9, one end portion 41*b* of a long conductor 41 in its width direction, which gradually decreases in thickness, and one end portion 42*a* of another long conductor 42 in its width direction, which also gradually decreases in thickness, overlap each other to form a connected long conductor 50. The thickness of the overlap portion is set so as not to exceed thickness t1 of the middle portion of each of the conductors 41 and 42. Since, therefore, the thickness t1 does not change and only the width increases several times, the connected long conductor 50 is formed as if it were a single one.

(Third Embodiment)

Figure 10:
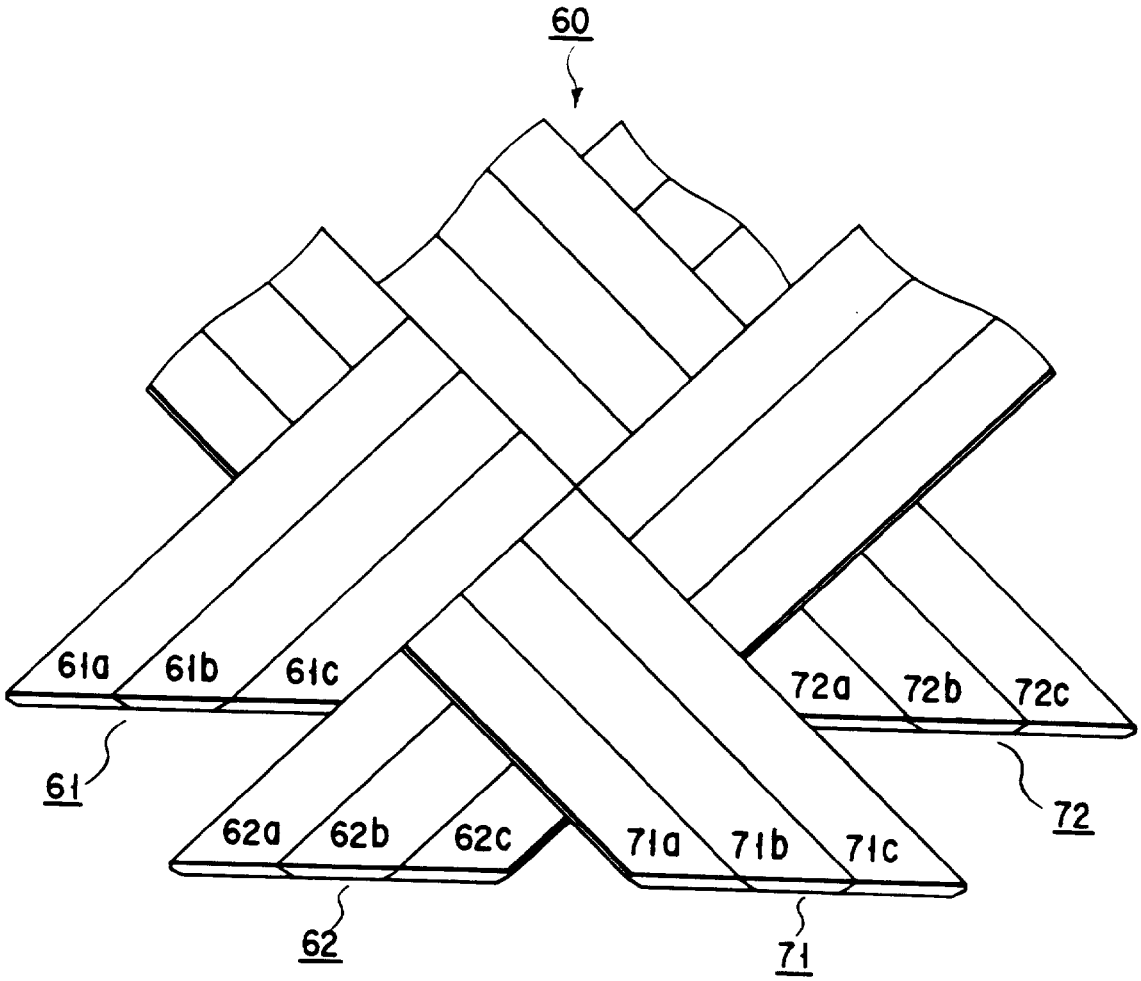
FIG. 10 is a partially cutaway perspective view of a braided wire according to a third embodiment of the present invention.

FIG. 10 is a view of the construction of a braided wire 60 according to a third embodiment of the present invention. The braided wire 60 is formed by weaving a plurality of first long conductor bunches 61, 62, . . . arranged in parallel and a plurality of second long conductor bunches 71, 72, . . .

arranged in parallel so as to cross the first and second long conductor bunches each other. Each of the first and second long conductor bunches includes a plurality of long conductors (three in this embodiment) 61*a*, 61*b* and 61*c*; 62*a*, 62*b* and 62*c*; . . . which are arranged in the width direction thereof. As in the above embodiments, each of the long conductors is flattened such that its thickness decreases toward both end portions in the width direction. The long conductor bunches are obtained by horizontally arranging the long conductors such that end portions of adjacent long conductors are put one on another. The first and second long conductor bunches are woven so as to be put one on another in the thickness direction. Since, in the braided wire 60, the long conductors are bunched, the weaving operation is simplified and the manufacturing costs are lowered.

The number of long conductors constituting the first and second long conductor bunches is set appropriately in view of the mechanical strength, manufacturing easiness, etc.

(Merits of the Embodiments)

The braided wire according to the above embodiments has the following structures and advantages.

[1] The braided wire 20 is constituted by weaving a plurality of first long conductors 21, 22, 23, arranged in parallel and a plurality of second long conductors 31, 32, 33, . . . arranged in parallel so as to cross the first and second long conductors each other. The braided wire 20 is characterized in that each long conductor E has a section X which is perpendicular to the axis of the conductor and flattened such that the thickness of the conductor is decreased toward both end portions in the width direction, and the flattened, first and second long conductors E are woven such that they are put one on another in the thickness direction.

Since, in the braided wire 20, each long conductor E having a section X crossing an axis thereof is flattened, the thickness of the wire 20 is considerably smaller than that of a conventional braided wire using long conductors each having the same area and a circular section crossing the axis, with the result that the braided wire 20 can greatly be thinned. As compared with a case where a small-diameter conductor is employed to reduce the thickness of the braided wire 20, the mechanical strength of the long conductor E is hardly lowered; therefore, the mechanical strength of the braided wire 20 is in no way inferior to that of the conventional one.

What is to be noted in particular is that, in an overlap between one (first) long conductor E and another (second) long conductor E crossing each other, both end portions Ea and Eb of the first long conductor E in its width direction, toward which the conductor E decreases in thickness, conform to a slant portion K which exhibits a "swell" formed along the longitudinal direction of the second long conductor E and in the thickness direction thereof and, in other words, a flexible "conformability" occurs between adjacent conductors. For this reason, a gap G caused by a step of the overlap between the crossing long conductors E is very small, with the result that the first and second long conductors has almost flat faces and few irregularities, though they are woven so as to cross each other. Thus, the braided wire has an outward appearance which is substantially the same as that of a single plate-like conductor having a fixed thickness T (which is about twice as great as that of each long conductor E). Consequently, the handling of the braided wire 20 is simplified and the shielding function thereof is improved. Furthermore, the wire 20 increases in mechanical strength and has flexibility at the same time.

[2] In the braided wire 20 described in above [1], each long conductor E is formed by flattening a long conductor having a circular section crossing the axis thereof.

The braided wire 20 has the same advantage as that of the braided wire described in [1]. In addition to this, the shape of section X perpendicular to the axis of the long conductor E is simply changed from a circle to a flatness, and the area of the section is constant, so that the thickness T can be smaller than and the mechanical strength can be equal to those in the conventional braided wire. Thus, the braided wire 20 can easily be manufactured.

[3] The braided wire 20 described in above [1] is characterized in that the section of the long conductor 40 crossing the axis thereof is determined such that a ratio (t1/W) of thickness t1 of the middle portion to width W is about (6 to 8)/100, while a ratio (t2/W) of thickness t2 of the end portions to width W is about (2 to 3)/100.

The braided wire 20 has the same advantage as that of the braided wire described in [1]. As shown in FIG. 8, both the end portions 40*a* and 40*b* can be deformed in the thickness direction. As illustrated in FIG. 9, one end portion 41*b* of the long conductor 41 in the width direction and one end portion 42*a* of another long conductor 42 in the width direction can be put one on another so as not to exceed thickness t1 of the middle portion of each of the conductors 41 and 42. As a result, the thickness t1 does not change and only the width increases several times, and the connected long conductor 50 can be formed as if it were a single one. Consequently, a long conductor having a required width according to a condition of use can easily and properly achieved.

[4] The braided wire 60 is constituted by weaving a plurality of first long conductor bunches 61, 62, . . . arranged in parallel and a plurality of second long conductor bunches 71, 72, . . . arranged in parallel so as to cross the first and second long conductor bunches.

Each of these long conductor bunches includes a plurality of long conductors (three in this embodiment) 61*a*, 61*b* and 61*c*; 62*a*, 62*b* and 62*c*; . . . which are arranged in the width direction thereof. Each of the long conductors is flattened such that its thickness decreases toward both end portions in the width direction. The first and second long conductor bunches are woven so as to be put one on another in the thickness direction.

Since, in the braided wire 60, the long conductors are bunched, the weaving operation is simplified and the manufacturing costs are lowered.

[5] In the braided wire 60 described in above [4], the long conductor bunches are obtained by horizontally arranging the long conductors such that end portions of adjacent long conductors are put one on another.

The braided wire 60 has the same advantage as that of the braided wire described in [4]. The characteristics of the first and second long conductors 61, 62, . . . and 71, 72, . . . are increased as a single long conductor, and thus the shielding function of the braided wire is improved.

[6] The braided wires 20, 40 and 60 are characterized in that they are applied to an outer conductor 13 of a coaxial cable 10 which is constituted of a center conductor 11, an insulator 12 covering the center conductor 11, the outer conductor 13 covering the insulator 12, and an outer coating 14 covering the outer conductor 13.

Since, in the braided wires 20, 40 and 60, the outer conductor can be decreased in thickness, an electronic device can be downsized by making an outside diameter of a coaxial cable smaller than that of a prior art one having the same function.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A braided wire comprising: a plurality of first long flat conductors arranged in parallel and a plurality of second long flat conductors arranged in parallel and crossing the plurality of first long flat conductors, the first and second long flat conductors being woven with each other, wherein each of the first and second long flat conductors has a cross section having a first flat side, a second flat side parallel to and longer than the first flat side, and both end sides curved from the first flat side to the second flat side so that both end portions of the cross section in a width direction gradually decrease in thickness and the first flat side of one of the first and second long flat conductors being in contact with the other of the first and second long flat conductors.

2. The braided wire according to claim 1, wherein the section of each of the long conductors crossing the axis thereof is determined such that a ratio (t1/W) of thickness t1 of a middle portion to width W is about (6 to 8)/100, while a ratio (t2/W) of thickness t2 of end portions to width W is about (2 to 3)/100.

3. The braided wire according to claim 1, which is applied to an outer conductor of a coaxial cable constituted of a center conductor, an insulator covering the center conductor, the outer conductor covering the insulator, and an outer coating covering the outer conductor.

4. The braided wire according to claim 1, wherein each of said first and second long flat conductors is a conductor formed by flattening a long conductor having a circular section.

* * * * *